US006832888B2

(12) United States Patent
Kabasawa et al.

(10) Patent No.: US 6,832,888 B2
(45) Date of Patent: Dec. 21, 2004

(54) MOLECULAR PUMP FOR FORMING A VACUUM

(75) Inventors: Takashi Kabasawa, Chiba (JP); Manabu Nonaka, Chiba (JP); Tooru Miwata, Chiba (JP)

(73) Assignee: BOC Edwards Technologies Limited, Narashino (JP)

( * ) Notice: Subject to any disclaimer, the term of this patent is extended or adjusted under 35 U.S.C. 154(b) by 35 days.

(21) Appl. No.: 10/278,188

(22) Filed: Oct. 22, 2002

(65) Prior Publication Data

US 2003/0077187 A1 Apr. 24, 2003

(30) Foreign Application Priority Data

Oct. 24, 2001 (JP) ..... 2001/325933

(51) Int. Cl.[7] ..... F04D 19/04
(52) U.S. Cl. ..... 415/90; 415/173.1; 415/129
(58) Field of Search ..... 415/90, 173.1, 415/173.2, 129, 131, 133

(56) References Cited

U.S. PATENT DOCUMENTS

| | | | | |
|---|---|---|---|---|
| 3,066,849 A | | 12/1962 | Beams | 230/117 |
| 4,502,832 A | * | 3/1985 | Becker | 415/90 |
| 5,011,368 A | * | 4/1991 | Frindel et al. | 415/90 |
| 5,154,572 A | | 10/1992 | Toyoshima et al. | 415/90 |
| 5,611,659 A | | 3/1997 | Dinner | 415/90 |
| 5,632,597 A | | 5/1997 | Hiroki et al. | 415/90 |
| 5,961,291 A | | 10/1999 | Sakagami et al. | 417/42 |
| 6,332,752 B2 | * | 12/2001 | Ikegami et al. | 415/90 |
| 6,435,847 B2 | * | 8/2002 | Kubo et al. | 417/423.4 |

FOREIGN PATENT DOCUMENTS

| | | |
|---|---|---|
| CH | 0234534 | 9/1944 |
| DE | 4227663 | 2/1994 |
| GB | 0242084 | 11/1925 |

* cited by examiner

*Primary Examiner*—Edward K. Look
*Assistant Examiner*—Igor Kershteyn
(74) *Attorney, Agent, or Firm*—Adams & Wilks

(57) ABSTRACT

A molecular pump for exhausting a chamber has a casing, a stator mounted in the casing, and a rotor mounted in the casing for undergoing rotation relative to the stator during exhaustion of the container. The rotor has a surface disposed opposite to and confronting a surface of the stator. A thread groove is formed in at least one of the opposite and confronting surfaces of the stator and the rotor. A clearance varying device varies a magnitude of a clearance between the opposite and confronting surfaces of the stator and the rotor. An exhaust controlling device controls a degree of exhaustion of the chamber by adjusting the magnitude of the clearance between the opposite and confronting surfaces of the stator and the rotor to a preselected target value during operation of the molecular pump.

20 Claims, 12 Drawing Sheets

PRIOR ART

PRIOR ART

MOLECULAR PUMP FOR FORMING A VACUUM

BACKGROUND OF THE INVENTION

1. Field of the Invention

The present invention relates to a molecular pump and, more specifically, to a molecular pump for exhausting or evacuating a chamber or container by the use of a thread groove pump stage.

2. Description of the Related Art

There is a growing need for a pump having a high exhaust capability and being able to achieve a high degree of vacuum with recent accelerated advance in scientific technology.

A molecular pump is widely used in the academic field or in the industrial field as a pump meeting such requirements of the users.

The molecular pump includes a thread groove pump, a turbo molecular pump, or the combination thereof.

FIG. 11 is an illustration of a structure of a molecular pump in the related art, constructed of a turbo molecular pump on the inlet port side and a thread groove pump on the exhaust port side.

A molecular pump 101 includes a turbo molecular pumping stage 102 and a thread groove pumping stage 103. Gas sucked through an inlet port 104 is compressed in the turbo molecular pumping stage 102, and then further compressed in the thread groove pumping stage 103, and finally discharged from an exhaust port 105.

The molecular pump 101 includes a rotor shaft 106, and the rotor shaft 106 is rotatably supported by magnetic bearings 107, 108, 109 about the axis. The magnetic bearings 107, 108 allow magnetic levitation of the rotor shaft 106 in the radial direction and a magnetic bearing 109 allows magnetic levitation of the rotor shaft 106 in the thrust direction.

The rotor shaft 106 includes a motor unit 110 substantially on the axial midsection thereof, and torque generated by the motor unit 110 allows fast axial rotation thereof.

A rotor 111 is secured on the rotor shaft 106 on the side of the inlet port 104 by means of a bolt. The rotor 111 includes a turbine section constituting a body of revolution of the turbo molecular pumping stage 102 and a cylindrical section 122 constituting a body of revolution of the thread groove pumping stage 103.

The turbine section is formed with a number of rotor vanes 112 of multiple stages in the radial direction. A casing 114 is formed with stator vanes 113 of multiple stages on the inner peripheral surface thereof so as to be directed toward the rotor shaft 106 and arranged alternately between the rotor vanes 112.

A thread groove spacer 116 is disposed around the outer peripheral surface of a cylindrical section 122 having a cylindrical outer peripheral surface with a predetermined clearance therefrom. The thread spacer 116 has a cylindrical inner peripheral surface, on which a thread groove 120 is formed in a helical manner.

The molecular pump 101 constructed as described above operates as follows.

After magnetic levitation of the rotor shaft 106 is effected by the magnetic bearings 107, 108, 109, the motor unit 110 is driven to rotate the rotor 111 and gas is sucked through the inlet port 104. Sucked gas is compressed in the turbo molecular pumping stage 102 and fed to the thread groove pumping stage 113 by the action of the rotor vanes 112 and the stator vanes 113. In the thread groove pumping stage 103, gas is guided through the thread groove 120 as a flow path along the cylindrical section 122 rotating at high-velocity, and is further compressed while being carried downwardly. In this manner, gas sucked through the inlet port 104 is compressed in the turbo molecular pumping stage 102, and then further compressed in the thread groove pumping stage 103, and finally discharged from the exhaust port 105.

In this manner, the reason why two types of molecular pump are combined is that the optimal pump differs depending on the pressure range. Accordingly, a molecular pump having a high compression ratio may be realized by constructing the front stage of gas compression of the turbo molecular pumping stage 102 and the rear stage of the thread groove pumping stage 103.

FIG. 12 shows a connecting state between the molecular pump 101 and a chamber 126 in the related art.

When the turbo molecular pump 101 is connected to the chamber 126 to which gas is discharged, the turbo molecular pump 101 may be connected via a gate valve 125. The gate valve 125 is disposed for adjusting the pressure in the chamber 126, and is capable of adjusting the pressure in the chamber 126 by adjusting the opening of the gate valve 125 while operating the turbo molecular pump 101.

However, in the thread groove pumping stage 103 in the related art, a clearance 121 between the rotor 122 and the surface opposed thereto is set to a certain value (for example, 1 mm) or more for ensuring safety and hence preventing the thread groove pumping stage 103 and the rotor 122 from coming into contact. As a result when the gas pressure discharged by the pump is increased, a backflow of gas may characteristically occur through the clearance 121 between the rotor 122 and the surface opposing thereto, which results in lowering of performance.

On the other hand, though there were market requirements to control the pressure by controlling exhaust capability of the pump, the only way was to change the revolution of the rotor 111 in the related art. However, changing the revolution of the rotor is time consuming and, as a result, the pressure of the chamber 126 is controlled by means of the expensive gate valve 125, which results in increase in costs.

SUMMARY OF THE INVENTION

Accordingly, it is an object of the invention to provide a molecular pump having a minimum clearance 12, having high gas compressibility, and being capable of controlling gas compressibility.

According to the invention, gas compressibility may be increased, and gas compressibility may be controlled in a molecular pump.

According to the invention, in order to achieve the object described above, there is provided a molecular pump including a stator, a rotor having an opposing surface that faces toward a predetermined surface of the stator and being rotatably supported with the opposing surface faced toward the surface, a motor for driving and rotating the rotor with respect to the stator, a thread groove formed on at least one of the surfaces of the stator and the rotor that face toward each other, a transport device for transporting gas through the thread groove by rotating the rotor by the motor, and a clearance varying device for varying the magnitude of the clearance between the opposing surfaces of the stator and the rotor (first structure).

The first structure may be achieved by providing a device that is capable of varying the magnitude of the clearance between the rotor and the surface opposed thereto as desired at the thread groove section of the thread groove pump or the turbo molecular pump. The clearance varying device allows setting of the magnitude of the clearance by means of a mechanism that moves the rotor or the surface opposing thereto in the axial direction by varying the floating position of the magnetic bearing. A thread groove is formed on at least one of the opposing surfaces of the rotor and the stator, so that gas is transported through the thread groove while being compressed with the rotation of the rotor.

The first structure may be such that the bus line of the surface of the rotor that faces toward the stator forms a predetermined angle, which is larger than zero degree at the smallest, with respect to the axis of the rotor, and the clearance varying device varies the magnitude of the clearance by moving at least one of the rotor and the stator in the direction of the axis of the rotor (second structure).

If the angle formed between the bus line and the axis is zero degree, the opposing surfaces of the rotor and the stator become cylindrical and if it is 90, the opposing surfaces of the rotor and the stator become disk shape. When it is a predetermined angle but not zero degree, the opposing surfaces becomes substantially cylindrical such as the outer peripheral surface of the conical shape, and thus the diameter of the substantially cylindrical shape varies in the axial direction. The rate of change of the diameters of the rotor and of the cylinder opposing thereto, that is, the angle formed between the bus line and the axis may be at least 10.

The second structure may be such that the rotor is rotatably supported by the magnetic bearing, and the clearance varying device moves the rotor in the axial direction by varying the amount of magnetic levitation in the direction of the axis of the rotor effected by the magnetic bearing (third structure).

The second structure may be such that the stator is held by an elastic member being capable of expanding and contracting in the direction of the axis of the rotor, and the clearance varying device moves the stator in the direction of the axis of the rotor by expanding and contracting the elastic member (fourth structure).

The first structure may be such that the outer peripheral surface of the rotor and the inner peripheral surface of the stator are cylindrical and the clearance varying device includes an inner diameter varying device for varying the inner diameter of the inner peripheral surface of the stator (fifth structure).

The clearance varying device may vary the magnitude of the clearance between the opposing surfaces of the rotor and the stator by a mechanism for adjusting the inner diameter of the opposing surface on the stator side.

The fifth structure may be such that the stator includes a stator constituent member divided in the circumferential direction of the inner peripheral surface thereof into a plurality of stator constituent members and an elastic member connecting the divided stator constituent members and being capable of expanding and contracting in the circumferential direction, and the inner diameter varying device varies the inner diameter of the inner peripheral surface of the stator by expanding and contracting the elastic member (sixth structure).

The mechanism for adjusting the inner diameter of the opposing surface on the stator side may be constructed of a cylinder divided into at least two pieces and parts (electrostrictive element) for supporting the same.

The fifth structure may be such that the stator includes the stator constituent member divided into a plurality of members circumferentially of the inner peripheral surface and an elastic member being attached to the outer peripheral surface of the stator constituent member at one end thereof and to the fixed portion at the other end thereof, and being capable of expanding and contracting in the radial direction of the inner peripheral surface, that a clearance is defined between the stator constituent members, and that the inner diameter varying device varies the inner diameter by moving the members radially by expanding and contracting the elastic member (seventh structure)

The fifth structure may be such that the stator is formed with a thread groove on the inner peripheral surface thereof, at least a part of the portion that constitute the thread of the thread groove is formed of the elastic member that is capable of expanding and contracting in the radial direction of the inner peripheral surface thereof, and the inner diameter varying device varies the inner diameter by expanding and contracting the elastic member (eighth structure).

The thread groove is formed on the surface opposing to the rotor (that is, the inner peripheral surface of the stator) and the height of the thread is variable.

Any one of the first to eighth structures may further include a measuring device for measuring the magnitude of the clearance between the rotor and the stator, and an adjusting device for adjusting the magnitude of the clearance by the use of the clearance varying device so that the magnitude of the clearance measured by the measuring device becomes a predetermined value (ninth structure)

The clearance between the opposing surfaces of the rotor and stator may be measured by the (clearance) measuring device such as an eddy current sensor, and controlled by performing feedback control on the margin of clearance based on the output from the measuring device.

It is also applicable to provide a device for measuring the temperature of at least one of the rotor and the surface opposing thereto as the measuring device for measuring the magnitude of the clearance to calculate the magnitude of the clearance based on the output signals therefrom.

Alternatively, the molecular pump that is capable of adjusting the clearance between the opposing surfaces of the rotor and the stator based on signals fed outside, such as the pressure in an exhausted container, and performing feedback control on the performance of the molecular pump, or a vacuum exhaust system using the same may be realized.

Any one of the fourth structure, and the sixth through the ninth structures may be such that the elastic member is formed of an electrostrictive element disposed so as to be capable of applying electric field, and the clearance varying device expands and contracts the electrostrictive element by varying the electric field to be applied on the electrostrictive element (tenth structure).

Any one of the first to the tenth structures may further include a detection device for detecting abnormal circumstance in which the rotor and the stator constituting the molecular pump body may come into contact with each other, and an emergency control device for varying the clearance between the rotor and the stator at least to the extent that is enough for avoiding the contact between them when abnormal condition is detected by the detection device (eleventh structure).

Furthermore, any one of the first to the eleventh structures may a pressure control device for varying the magnitude of the clearance based on the detection signals of the gas pressure in the vacuum container, so that the pressure in the vacuum container may be controlled (twelfth structure).

DETAILED DESCRIPTION OF THE PREFERRED EMBODIMENTS

1. First Embodiment

According to the first embodiment, the clearance between the rotor and the surface opposing thereto in the thread groove pumping stage is adjusted by moving the rotor with respect to the stator in the direction of the axis of revolution. The amount of gas leaked through the clearance may be adjusted by adjusting the clearance.

Figure 1:
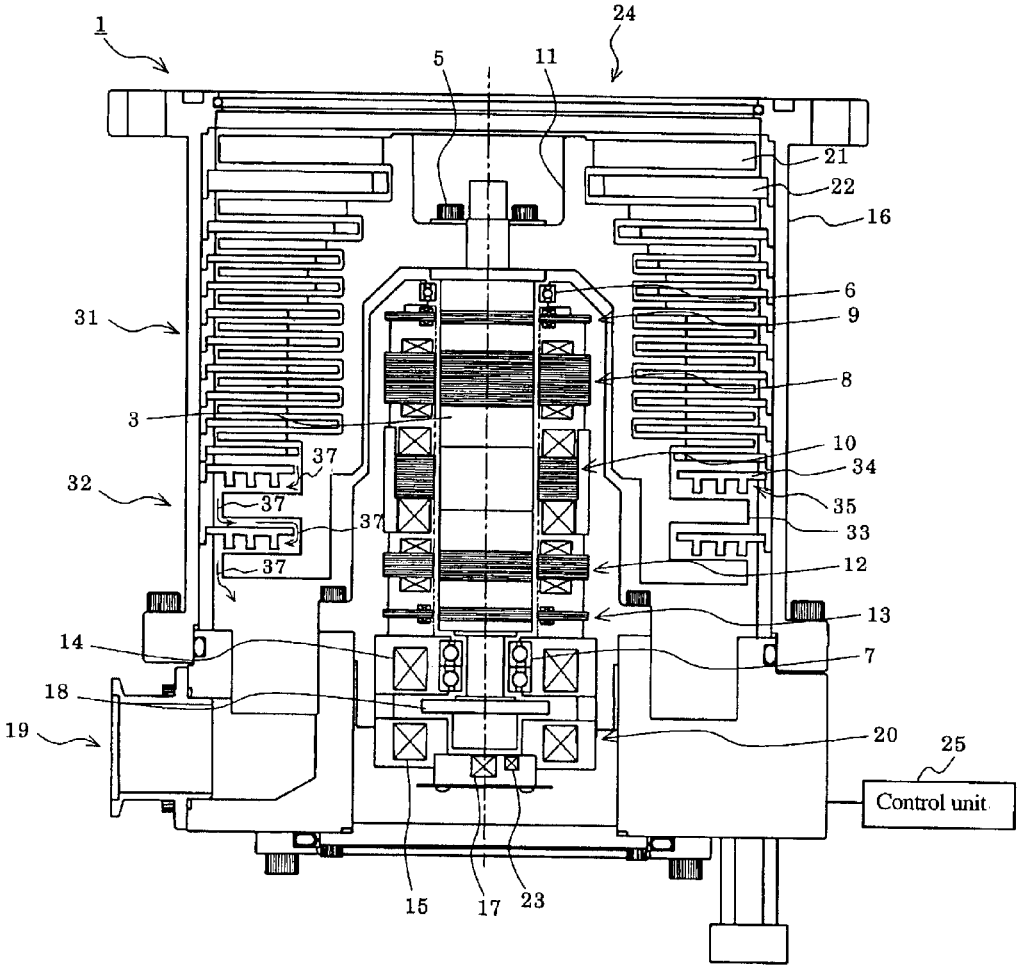
FIG. 1 is a view showing the structure of a molecular pump according to the first embodiment.
Figure 2:
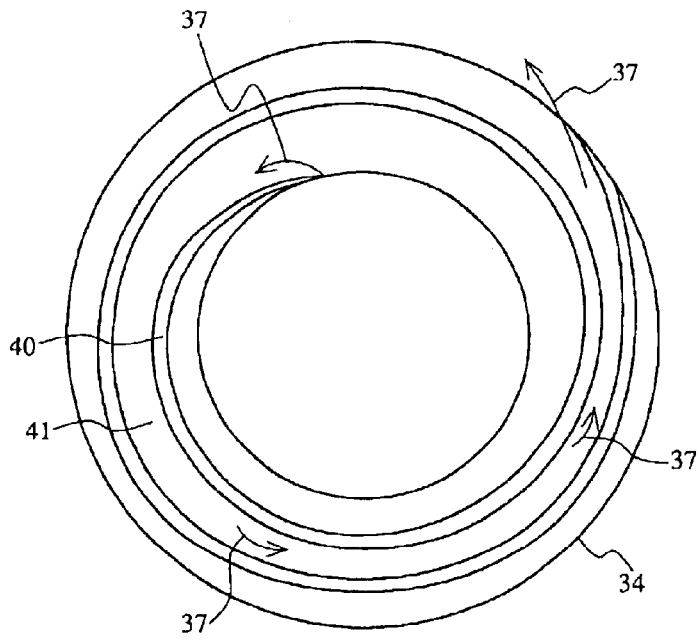
FIG. 2 is view showing a grooved stator seen from the bottom side of FIG. 1.
Figure 3:
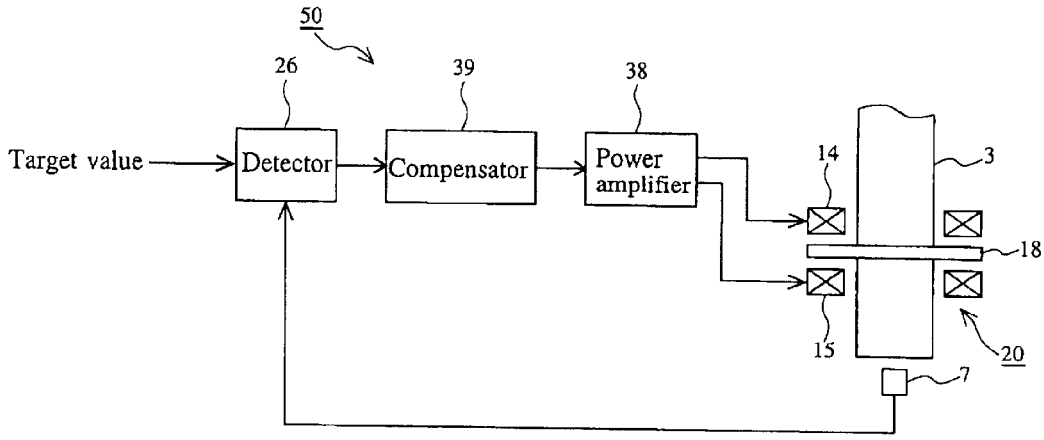
FIG. 3 is a view showing the structure of a control system of a magnetic bearing unit.

Referring now to FIGS. 1–3, the first preferred embodiment of the invention will be described in detail.

FIG. 1 is a view showing the structure of the molecular pump 1 according to the first embodiment. A molecular pump 1 includes a turbo molecular pumping stage 31 and a thread groove pumping stage 32, and gas sucked through an inlet port 24 is compressed in the turbo molecular pumping stage 31 and then is further compressed in the thread groove pumping stage 32, and finally discharged through an exhaust port 19.

A rotor shaft 3 is disposed at the center of a casing 16 forming the outer enclosure of the molecular pump. Magnet bearing units 8, 12, 20 are disposed at the upper portion, the lower portion, and the bottom portion of the rotor shaft 3 respectively when viewed toward the plane of the figure.

The magnet bearing units 8, 12 support the rotor shaft 3 so as to be magnetically levitated in the radial direction (in the direction of radius of the rotor shaft 3) without contact, and the magnetic bearing unit 20 supports the same so as to be magnetically levitated in the thrust direction (in the direction of the axis of the rotor shaft 3) without contact.

Such magnetic bearing units constitute a so-called five-shaft control magnetic bearing, and the rotor shaft 3 an a rotor 11 attached on the rotor shaft 3 are free to rotate about the axis of the rotor shaft 3.

The magnetic bearing unit 8 includes four electromagnets disposed every 90 degrees around the rotor shaft 3 so as to face with each other. The rotor shaft 3 is formed of a material having high magnetic permeability such as iron, and is adapted to be attracted by a magnetic force of these electromagnets.

A displacement sensor 9 is, for example, an eddy current sensor for detecting radial displacement of the rotor shaft 3.

The control unit 25 adjusts a magnetic force of each electromagnet to bring the rotor shaft 3 back to the predetermined position upon detection of the fact that the rotor shaft 3 is displaced radially from the predetermined position based on the displacement signals from the displacement sensor 9. A magnetic force of the electromagnet is adjusted by performing feedback control on exciting current of each electromagnet.

In this manner, the rotor shaft 3 is magnetically levitated at a predetermined clearance from the electromagnet at the magnetic bearing unit 8 and kept in the space without contact. As will be described later, the control unit 25 performs control of the magnetic bearing units 12, 20, and a motor unit 10 in addition to the control of the magnetic bearing unit 8.

The structure and the action of the magnetic bearing unit 12 is the same as those of the magnetic bearing unit 8.

The magnetic bearing unit 12 includes four electromagnets disposed at every 90 degrees around the rotor shaft 3, and the rotor shaft 3 is held at the magnetic bearing unit 12 without contact in the radial direction by an attraction of these electromagnets.

A displacement sensor 13 is, for example, an eddy current sensor, and detects displacement of the rotor shaft 3 in the radial direction.

When the rotor shaft 3 receives signals indicating displacement in the radial direction from the displacement sensor 13, the control unit 25 performs feedback control on exciting current of the electromagnet to correct the displacement and hold the rotor shaft 3 at the predetermined position.

The control unit 25 performs feedback control on the magnetic bearing unit 12 based on signals from the displacement sensor 13, whereby the rotor shaft 3 is magnetically levitated in the radial direction at the magnetic bearing unit 12, and held in the space without contact.

The magnetic bearing unit 20 provided at the lowest end of the rotor shaft 3 is constructed by a circular metallic disc 18, electromagnets 14, 15, and a displacement sensor 17, so that the rotor shaft 3 is held in the thrust direction.

The metallic disc 18 is formed of material having high magnetic permeability such as iron, and is fixed at its center to the rotor 3 in the vertical direction. The electromagnet 14 is disposed on the metallic disc 18, and the electromagnet 15 is disposed under the metallic disc 18. The electromagnet 14 attracts the metallic disc 18 upward by its magnetic force, and the electromagnet 15 attracts the metallic disc 18 downward by its magnetic force. The control unit 25 adjusts the magnetic force that is applied on the metallic disc 18 by the electromagnets 14, 15 as needed, and allows the rotor shaft 3 to be magnetically levitated in the thrust direction and held in the space without contact.

The displacement sensor 17 is, for example, an eddy current sensor for detecting displacement of the rotor shaft 3 in the thrust direction and transmitting it to the control unit 25. The control unit 25 observes displacement of the rotor shaft 3 in the thrust direction based on the displacement detection signals received from the displacement sensor 13.

When the rotor shaft 3 is moved in either side in the thrust direction and displaced from the predetermined position, the control unit 25 performs feedback control on exciting current of the electromagnets 14, 15 to correct displacement and adjusts the magnetic force, so that the rotor shaft 3 is moved back to the predetermined position. Feedback control performed by the control unit 25 allows the rotor shaft 3 to be magnetically levitated in the thrust direction and held at the predetermined position.

As is described thus far, the rotor shaft 3 is held in the radial direction by the magnetic bearing units 8, 12, and held in the thrust direction by the magnetic bearing unit 20, so that the rotor shaft 3 is held so as to rotate about the axis thereof.

A protective bearing 6 is provided on the magnetic bearing unit 8 and a protective bearing 7 is provided under the magnetic bearing unit 12 respectively in the direction of the axis of the rotor shaft 3.

Though the rotor shaft 3 is magnetically levitated and held in the space without contact by the magnetic bearing units 8, 12, 20, the rotor shaft 3 may be displaced significantly from the held position due to occurrence of deflection about the axis of rotor shaft 3. The protective bearings 6, 7 are provided for preventing the rotor shaft 3 from coming into contact with the electromagnets of the magnetic bearing units 8, 12, 20, or a permanent magnet from coming into contact with the electromagnets in the motor unit 10 in such a case.

When the rotor shaft 3 is displaced by more than a certain extent from the predetermined position, the rotor shaft 3 comes into contact with the protective bearings 6, 7 and thus the movement of the rotor shaft 3 is physically limited.

The rotor shaft 3 is provided with the motor unit 10 between the magnetic bearing units 8, 12. In this embodiment, a DC brushless motor having the following structure described below is employed as an example.

In the motor unit 10, a permanent magnet is attached around the rotor shaft 3.

The permanent magnet is arranged, for example, so that the N-pole and the S-pole are disposed at every 180 degrees.

For example, six electromagnets are arranged at every 60 degrees around the permanent magnet at predetermined clearance from the permanent magnet symmetrically with respect to the axis of the rotor shaft 3 so as to face toward each other.

A revolution sensor 23 is mounted at the lower end of the rotor shaft 3. The control unit 25 is adapted to be able to detect revolution of the rotor shaft 3 based on the detected signals from the revolution sensor 23. Though it is not shown in the figure, a sensor for detecting the phase of revolution of the rotor shaft 3 is mounted in the vicinity of the displacement sensor 13, and the control unit 25 is adapted to detect the position of the permanent magnet using the detection signals from this sensor and from the revolution sensor 23.

The control unit 25 switches current of the electromagnets depending on the detected position of the magnetic pole in sequence so that revolution of the rotor shaft 3 is maintained. In other words, the control unit 25 generates a rotating magnetic field around the permanent magnet fixed on the rotor shaft 3 by switching exciting current of six electromagnets, and rotates the rotor shaft 3 by allowing the permanent magnet to follow this rotating magnetic field.

The rotor 11 is secured on the rotor shaft 3 by a plurality of bolts 5, so that the rotor 11 rotates with rotation of the rotor shaft 3 driven by the motor unit 10.

The rotor 11 includes a turbine unit corresponding to the turbo molecular pumping stage 31 and a disc unit corresponding to the thread groove pump unit 32.

In the turbine unit, rotor vanes 21 are attached in a multiple stages so as to extend radially from the rotor 11 at a predetermined angle from the plane perpendicular to the axis of the rotor shaft 3. The rotor vanes 21 are attached on the rotor 11, and adapted to rotate with the rotor 11 at a high speed.

The portion of the casing 16 corresponding to the turbo molecular pumping stage 31 is fixed with stator vanes 22 so as to extend alternately between the stages of the rotor vanes 21 toward the inside of the casing 16. The stator vanes 22 are secured on the casing 16 at a predetermined angle from the plane perpendicular to the axis of the rotor shaft 3.

The disc unit of the rotor 11 is formed with a circular disc 33 that corresponds to the rotor in the thread groove pumping stage 32. On the other hand, the portion of the casing 16 corresponding to the thread groove pumping stage 32 is formed with a grooved stator 34 having a helical path as a gas passage formed on the disc so as to extend toward the inside of the casing 16. A predetermined clearance 35 is formed between a disc 33 and the grooved stator 34.

When the rotor is formed of a disc as described above, the angle formed between the bus line of the surface o the rotor opposing to the stator and the axis of the rotor shaft 3 is 90 degrees.

In this case, the bus line represents a straight line forming a curved surface such as a conical surface, cylindrical surface, or a hyperboloid of one sheet at each position. The bus line of the disc 33 is a segment line that draws a radius of the disc 33.

FIG. 2 is a drawing showing the grooved stator 34 seen from the lower side of FIG. 1.

The grooved stator 34 is formed with a helical groove 41 by a projection 40 as shown in FIG. 2.

An arrow 37 represents the direction of gas flow. The surface opposing to the grooved stator 34 is the disc 33, and gas enters from the inner peripheral side of the grooved stator 34 into the helical groove 41 by high-speed rotation of the disc 33, and guided in the helical groove 41 in the direction indicated by the arrow 37. The helical groove 41 is narrowed gradually from the inner periphery toward the outer periphery, and a centrifugal force acting on gas increases gradually from the inner peripheral side toward the outer peripheral side, so that gas is pressurized while moving from the inner peripheral side toward the outer peripheral side of the grooved stator 34.

In this manner, a transport device for transporting gas through the helical groove 41 is formed by arranging the grooved stator 34 and the disc 33 so as to face with each other at a predetermined distance.

Referring back to FIG. 1, gas compressed in the turbo molecular pumping stage 31 is further compressed while being guided from the inner peripheral side to the outer peripheral side of the grooved stator 34 in the first stage as shown by the arrow 37, and subsequently, it is further compressed while being guided from the inner peripheral side to the outer peripheral side of the grooved stator 34 in the second stage, and finally discharged from the exhaust port 19.

Since the rotor 11 is magnetically levitated in the thrust direction by the magnetic bearing unit 20, the rotor 11 may be moved in the vertical direction in the figure by offsetting the preset value (target value) in feedback control on the magnetic bearing unit 20 in the direction of the axis of the rotor shaft 3.

In this manner, vertical movement of the rotor 11 allows adjustment of the magnitude of the clearance 35 between the grooved stator 34 and the disc 33. Reducing the clearance 35 results in reduction of gas leaked through the clearance 35 in the course of compression and hence achievement of high compressibility in the molecular pump 1. In contrast to it, increasing the clearance 35 results in increase in amount of gas leaked therethrough, and hence achievement of smaller compressibility in the molecular pump 1.

In this manner, exhaust capability of the molecular pump 1 may be adjusted by making the magnitude of the clearance 35 controllable.

Consequently, the pressure in the chamber (exhausted container) may be adjusted. In addition, exhaust capability of the molecular pump 1 may be increased to the level higher than in the related art by setting the magnitude of the clearance 35 to the distance smaller than the fixed clearance in the related art.

FIG. 3 is a drawing showing the structure of a control system 50 of the magnetic bearing unit 20. The control system 50 includes the magnetic bearing unit 20 (the electromagnets 14, 15, the metallic disc 18), the displacement sensor 17, a detector 26, a compensator 39, a power amplifier 38, and so on. Out of these units, the detector 26, the compensator 39, and the power amplifier 38 are included in the control unit 25.

The functions of the magnetic bearing unit 20 and the displacement sensor 17 are as described above. Since the magnitude of the clearance 35 may be detected based on the output from the displacement sensor 17, the displacement sensor 17 constitutes a measuring device for measuring the magnitude of the clearance 35.

The detector 26 compares the preset target value and the output from the displacement sensor, and generates error signals indicating the difference between them.

The compensator 39 receives the error signals, and performs compensation such as PID (Proportional Integral Derivative) compensation. The compensator 39 outputs the compensated control signals to the power amplifier 38.

The compensator 39 is for compensating the received error signals by means of a predetermined method, and improving controllability of the magnetic bearing unit 20.

The power amplifier 38 receives control signals from the compensator 39, and supplies current corresponding to the control signals to the electromagnets 14, 15. The electromagnets 14, 15 generate a predetermined magnetic field by supplied current, and hold the rotor shaft 3 at the position predetermined by the target value. Therefore, making the target value variable, the rotor shaft 3 may be offset in the thrust direction.

In this manner, a clearance varying device for varying the magnitude of the clearance 35 may be configured by the control system 50 by allowing the control system 50 to offset the rotor shaft 3 in the thrust direction.

The control system 50 also configures an adjusting device for adjusting the magnitude of the clearance 35 for performing feedback control on the magnitude of the clearance 35 so that the target value is achieved.

In the present embodiment, the user can set the target value to be input into the compensator 30. For example, a dial for changing the target value is provided on the control panel, not shown, of the molecular pump 1, so that the user can change the target value while measuring the pressure in the chamber. When reducing the magnitude of the clearance 35 by changing the target value, exhaust capability of the molecular pump 1 increases and the pressure in the chamber is lowered. In contrast to it, when increasing the magnitude of the clearance 35, exhaust capability of the molecular pump 1 is reduced, and the pressure in the chamber increases. The user can adjust the magnitude of the clearance 35 to an optimal value by dial control. Thus an exhaust controlling device is provided by the adjusting device as described above for controlling the degree of exhaustion by the molecular pump 1.

Alternatively, a pressure measuring device for measuring the pressure in the chamber may be provided so that feedback control is performed on the clearance 35 to make the pressure obtained by the pressure measuring device agree with the target value.

The molecular pump 1 and the control unit 25 are provided with error detection capability for enhancing the safety.

By configuring a security device with the error detection capability so that the magnitude of the clearance 35 is adjusted to a safe value immediately when a disturbance such as vibrations of the molecular pump 1 occurred due to an external force, interference between the rotor 35 and the grooved stator 34 may be prevented.

The items to be detected include the position of the rotor 11 and the temperature of the motor unit 10. The position of the rotor 11 is monitored by the displacement sensors 9, 13, 17, and the temperature of the motor unit is monitored by a thermistor and the like mounted on the electromagnet in the motor unit, not shown.

The molecular pump 1 arranged as described above operates as follows.

When the molecular pump 1 is actuated, the control unit 25 performs feedback control on the magnetic bearing units 8, 12, 20 based on signals from the displacement sensors 9, 13, 17 to magnetically levitate the rotor shaft 3.

Subsequently, the control unit 25 actuates the motor unit 10 to rotate the rotor 11. Then gas is sucked through the inlet port 24. Gas is compressed by the action of the rotor vanes 21 and the stator vanes 22 in the turbo molecular pumping stage 31 and fed to the thread groove pumping stage 32. Gas is further compressed while being guided through the helical groove 41 of the grooved stator 35 by the disc 33 in the thread groove pumping stage 32, and then is discharged from the exhaust port 19.

When the molecular pump 1 is in operation, the user can vary the magnitude of the clearance 35 by turning the dial on the control panel.

When the user turns the dial and changes the target value to be input into the compensator 39, the control system 50 changes a magnetic force of the electromagnets 14, 15 while detecting the thrust position of the rotor shaft 3 with the displacement sensor 17, and moves the rotor shaft 3 to the predetermined position predetermined by the target value.

When the user operates the dial and moves the rotor shaft 3 to the side of the inlet port 24, the magnitude of the clearance 35 is reduced, and thus gas leaked through the clearance 35 reduces, whereby exhaust capability of the molecular pump 1 may be improved. As a consequent, the degree of vacuum in the exhausted container may be increased.

On the other hand, when the user operates to move the rotor shaft 3 to the side of the exhaust port 19, the magnitude of the clearance 35 increases, and thus gas leaked through the clearance 35 increases, whereby exhaust capability of the molecular pump 1 may be lowered. As a consequent, the degree of vacuum in the exhausted container may be reduced.

According to the first embodiment described thus far, the following effects may be achieved.

Exhaust capability of the molecular pump 1 may be controlled by adjusting the clearance 35.

Since exhaust capability of the molecular pump 1 can be adjusted only by changing the target value by means of the control system 50 for the magnetic bearing unit 20, the structure to be added is simple, and may be realized at low costs. In addition, it is superior in responsibility.

Since the performance of the molecular pump 1 may be controlled, a throttle valve (gate valve) for controlling the pressure may be eliminated, and thus the cost may be reduced.

Generally, when using the molecular pump 1, another vacuum pump is connected to the exhaust port 19 as an auxiliary pump, so that the pressure at the exhaust port 19 (exhaust back pressure) is lowered. Since the clearance 35 between the disc 33 and the surface opposing thereto may be reduced, the performance of the molecular pump 1 especially with high exhaust back pressure may be improved, such as the case in which a small back pump (auxiliary pump) is used.

Since the clearance between the disc 33 and the surface opposing thereto may be increased by increasing the set value of the clearance 35 in case of emergency, contact between the disc 33 and the surface opposing thereto may be prevented, thereby increasing reliability.

Though the molecular pump 1 includes the turbo molecular pumping stage 31 and the thread groove pumping stage 32, it is not limited thereto, and the invention may be applied to the molecular pump having only the thread groove pumping stage 32.

Though the thread groove pumping stage 32 in the present embodiment is formed with the groove 41 as a gas passage on the stator side, it is not limited thereto, and the groove may be formed on the surface of the disc 33.

2. Second Embodiment

In the second embodiment, an example in which the clearance between the rotor and the surface opposing thereto in the thread groove pumping stage is adjusted by moving the stator with respect to the rotor in the direction of the axis of rotation of the rotor will be described.

Figure 4:
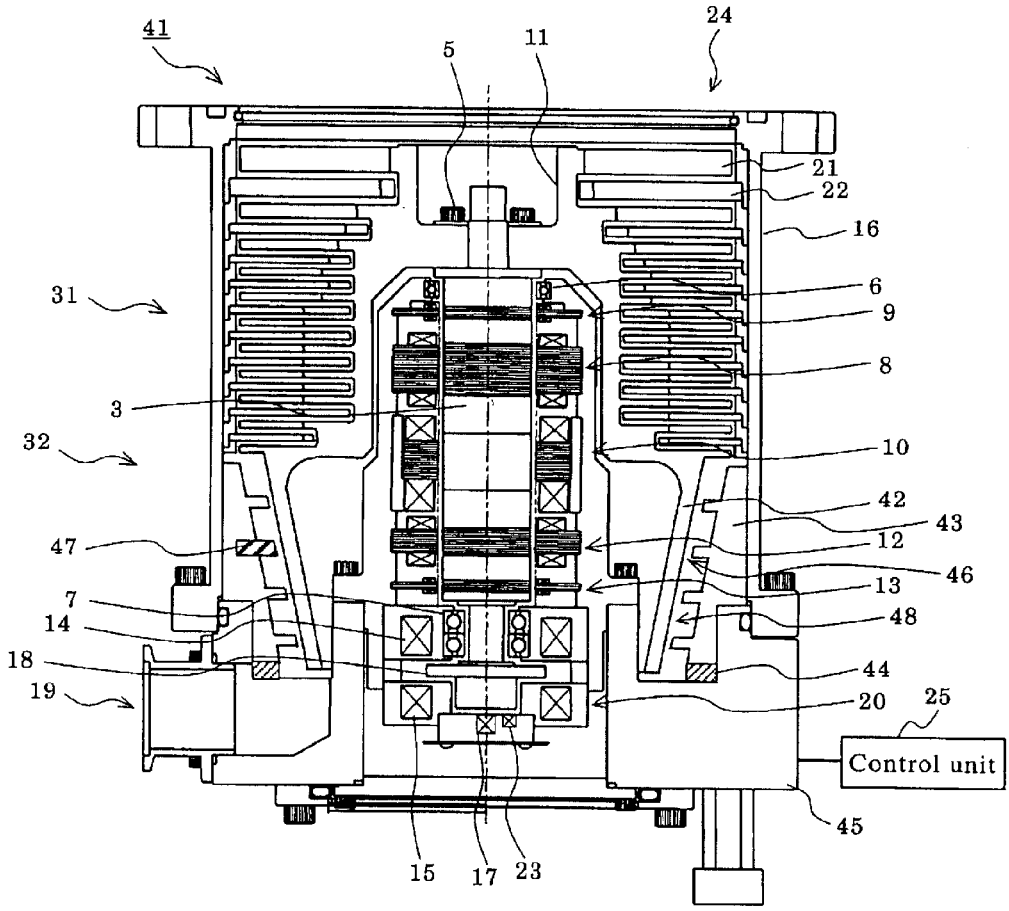
FIG. 4 is a view showing the structure of the molecular pump according to the second embodiment.
Figure 5:
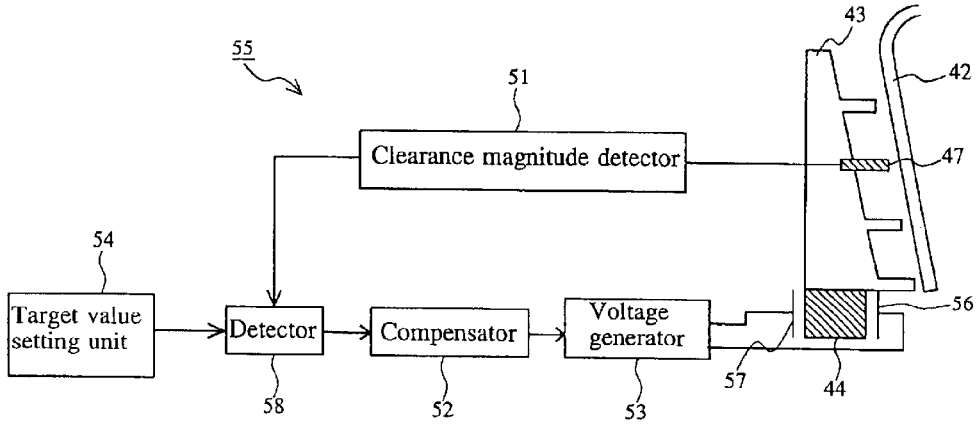
FIG. 5 is an illustration of the structure of an electrostrictive element controller.

Referring now to FIG. 4 and FIG. 5, the preferred second embodiment of the invention will be described in detail.

FIG. 4 is a drawing showing the structure of the molecular pump 41 according to the second embodiment. The same parts as in the first embodiment are identified by the same reference numerals.

The molecular pump 41 includes a turbo molecular pumping stage 31 provided on the side of the inlet port 24, and a thread groove pumping stage 32 formed on the side of the inlet port 19.

Since the structure of the magnetic bearing units 8, 12, 20, the motor unit 10, the rotor shaft 3, and the turbo molecular pumping stage 31 are the same as in the first embodiment, the description will not be repeated again.

The thread groove pumping stage 32 includes a rotor 42 having an outer peripheral surface of conical shape, and a thread groove spacer 43 formed with a thread groove on the inner peripheral surface.

These conical shapes area formed with their apexes faced toward the lower side of the figure. The cross section of the rotor 42 including the axis of the rotor shaft 3 is trapezoidal. The bus line of the rotor 42 on the surface opposing to the stator is a side connecting the upper base and the lower base of the trapezoid.

In the present embodiment, the angle formed between the cone with the axis of the rotor shaft 3, that is, the angle formed between the bus line of the cone and the vertical line, is in the order of 10 degrees.

A thread groove 48 formed on the inner peripheral surface of the thread groove spacer 43 has a helical shape. When the rotor 42 rotates at high speed, gas compressed in the turbo molecular pumping stage 31 is transported to the exhaust port 19 while being guided through the thread groove 48 along with the rotation of the rotor 42. In other words, the thread groove 48 configures a gas passage for transporting gas.

The thread groove spacer 43 and the rotor 42 facing toward each other at a predetermined clearance define a transport device for transporting gas through the thread groove 48.

The cross sectional area of the gas passage defined by the side surface of the rotor 42 and the thread groove 48 reduces gradually toward the exhaust port 19. Therefore, gas is compressed more as it moves through the thread groove 48 toward the exhaust port 19.

In this manner, gas sucked through the inlet port 24 is compressed in the turbo molecular pumping stage 1 and then further compressed in the thread groove pumping stage 32, and finally discharged from the exhaust port 19.

The thread groove spacer 43 is disposed so as to be capable of moving in the casing 16 in the direction of the axis of the rotor shaft 3, and is provided with a ring-shaped electrostrictive element (piezo element) 44 attached on the lower end. The other end of the electrostrictive element 44 is attached on a base 45 of the molecular pump 1. In other words, when the electrostrictive element 44 expands or contracts in the thrust direction, the thread groove spacer 43 moves correspondingly in the thrust direction.

The electrostrictive element is formed of ferroelectric substance such as barium titanate, which expands and contracts when electric field is impressed thereon. In this embodiment, it expands and contracts in the thrust direction. In this embodiment, the electrostrictive element is used as an elastic member. Though it is not shown in the figure, ring-shaped electrodes are attached on the inner peripheral surface and the outer peripheral surface of the electrostrictive element 44 respectively, so that electric field can be impressed on the electrostrictive element 44 by applying a voltage on the electrodes.

When a voltage is applied on these electrodes mounted on the electrostrictive element 44 and electric field is impressed on the electrostrictive element 44, the electrostrictive element 44 generates a mechanical stress, and expands and contracts in the thrust direction (the direction of the axis of the rotor shaft 3). When the electrostrictive element 44 expands and contracts, the thread groove spacer 43 moves correspondingly in the thrust direction.

The magnitude of a clearance 46 between the rotor 42 and the thread groove spacer 43 reduces when the thread groove spacer 43 moves upward in the figure and increases when it moves downward.

On the other hand, the amount of expansion and contraction of the electrostrictive element 44 may be adjusted by adjusting the voltage to be applied on the electrostrictive element 44. A clearance varying device for varying the magnitude of the clearance 46 by the electrostrictive element 44 may be configured in this manner.

The thread groove spacer 43 is provided with an eddy current sensor 47 as a clearance measuring device for measuring the magnitude of the clearance 46. The eddy current sensor 47 is provided with a detection coil that constitutes a part of a transmission circuit at the distal end thereof, and detects the distance from the distal end of the eddy current sensor 47 to the rotor 42 from variations in impedance of the detection coil. The eddy current sensor 47 is disposed in the hole formed on the thread of the thread groove spacer 43, and the distal end is exposed from the inner periphery of the thread groove spacer 47. The eddy current sensor 47 configures the measuring device for measuring the magnitude of the clearance 46 in this manner.

The control unit 25 includes a controller for the magnetic bearing units 8, 12, 20, a controller for the motor unit 10, and an electrostrictive element controller for controlling the electrostrictive element 44.

The functions of the controller for the magnetic bearing units 8, 12, 20 and the controller for the motor unit 10 are the same as in the first embodiment.

The electrostrictive element controller for controlling the amount of expansion and contraction of the electrostrictive element 44 detects the clearance between the rotor 42 and the thread groove spacer 43, or the magnitude of the clearance 46, based on the output from the eddy current sensor 47, and performs feedback control on the electric field to be impressed on the electrostrictive element 44 so that the clearance 46 becomes the predetermined magnitude. In this manner, the control unit 25 configures an adjusting device for adjusting the magnitude of the clearance 46 by controlling the clearance varying device.

FIG. 5 is a drawing showing an example of the structure of an electrostrictive element control system 55.

The electrostrictive element control system 55 includes the eddy current sensor 47, a clearance magnitude detector 51, a target value setting unit 54, a compensator 52, a voltage generator 53, electrodes 56, 57, and the electrostrictive element 44. Out of these units, the clearance magnitude detector 51, the target value setting unit 54, the compensator 52, and the voltage generator 53 are provided in the control unit 25.

The target value in the target value setting unit 54 may be varied by controlling dial on the control panel, not shown, for the turbo molecular pumping stage 41.

The clearance magnitude detector 51 detects the magnitude of the clearance between the eddy current sensor 47 and the rotor 42 from the variations in impedance of the eddy current sensor 47, and outputs signals indicating the magnitude of the clearance.

The target value setting unit 54 outputs signals indicating the target value of the magnitude of the clearance between the thread groove spacer 43 and the rotor 42.

A detector 58 outputs error signals indicating difference between the magnitude of the clearance detected by the clearance magnitude detector 51 and the magnitude of the clearance preset by the target value setting unit 54.

The compensator 52 receives the error signals from the detector 58, and outputs the control signals indicating the voltage value corresponding to the error signals.

The voltage generator 53 receives the control signals from the compensator 52 and applies a voltage on the electrodes 56, 57. The electrode 56 is an electrode mounted on the inner side of the electrostrictive element 44, and the electrode 57 is an electrode mounted on the outside of the electrostrictive element 44. When a voltage is applied on the electrode 56 and the electrode 57 by the voltage generator 53, magnetic field is generated between the electrode 56 and the electrode 57, whereby the electrostrictive element 44 expands and contracts. For example, it is adapted to apply a positive voltage on the electrode 56 and a negative voltage on the electrode 57.

The electrostrictive element control system 55 performs feedback control so that the magnitude of the clearance detected by the clearance magnitude detector 51 agrees with the magnitude of the clearance preset by the target value setting unit 54.

Referring back to FIG. 4, the following effects are achieved by adjusting the clearance 46 between the rotor 42 and the thread grove spacer 43 by the electrostrictive element 44 as described above.

Though gas is compressed as it moves toward the exhaust port 19 in the thread groove pumping stage, gas leaks through the clearance 46 during the movement.

When the magnitude of the clearance 46 is significant, the amount of leaked gas increases, and thus gas compressibility in the thread groove pumping stage 32 is lowered. Therefore, exhaust capability of the molecular pump 41 may be reduced.

On the other hand, when the magnitude of the clearance 46 is small, the amount of leaked gas is reduced, and thus gas compressibility in the thread groove pumping stage 32 is improved. Therefore, exhaust capability of the molecular pump 41 may be improved.

The user may adjust exhaust capability of the molecular pump 41 by setting the target value setting unit 54 for the target value.

The molecular pump 41 thus arranged acts as follows.

When the molecular pump 41 is actuated, the control unit 25 performs feedback control on the magnetic bearing units 8, 12, 20 based on the signals from the displacement sensors 9, 13, 17, and magnetically levitates the rotor shaft 3.

Subsequently, the control unit 25 actuates the motor unit 10, and rotates the rotor 11. Then gas is sucked through the inlet port 24. Gas is compressed by the action of the rotor vanes 21 and the stator vanes 22 in the turbo molecular pumping stage 31, and fed to the thread groove pumping stage 32.

Gas is further compressed while being guided through the thread groove 48 formed on the thread groove spacer 43 toward the exhaust port 19 by the high-speed rotation of the rotor 42 in the thread groove pumping stage 32, and then is discharged through the exhaust port 19.

When the molecular pump 41 is in operation, the user can vary the magnitude of the clearance 46 by turning the dial on the control panel.

When the user turns the dial and changes the target value in the target value setting unit 54, the electrostrictive element control system 55 impresses predetermined electric field on the electrostrictive element 44 while detecting the distance between the eddy current sensor 47 and the rotor 42, so that the value of the clearance 46 agrees with the value preset by the target value setting unit 54.

Reduction of the magnitude of the clearance 46 by dial control of the user allows reduction of gas leaked through the clearance 46, and improvement of exhaust capability of the molecular pump 41. As a consequent, the degree of vacuum in the exhausted container may be increased.

On the other hand, when the magnitude of the clearance 46 is increased by the dial control of the user, gas leaked through the clearance 46 increases, and thus exhaust capability of the molecular pump 41 may be reduced. As a consequent, the degree of vacuum in the exhausted container may be reduced.

The control unit 25 is provided with a safety device for changing the magnitude of the clearance 46 to the safe value and preventing interference between the rotor 42 and the thread groove spacer 43 by contracting the electrostrictive element 44 immediately when a disturbance such as vibrations of the molecular pump 41 occurred due to an external force as in the first embodiment.

According to the second embodiment described thus far, the following effects may be achieved.

Controlling the clearance 46 allows control of exhaust capability of the molecular pump 41.

The magnitude of the clearance 46 may be adjusted by expansion and contraction of the electrostrictive element 44. In addition, since the clearance 46 may be adjusted only by impressing electric field on the electrostrictive element 44, it needs little electricity to work. Furthermore, the electrostrictive element 44 is superior in responsibility.

Such effects that the gate valve can be eliminated, the performance of the pump with high exhaust back pressure may be improved, and the magnitude of the clearance 46 can be increased immediately in case of emergency to ensure the security are the same as in the first embodiment.

Though an electrostrictive element 44 is used as a drive unit for moving the thread groove spacer in the vertical direction in this embodiment, the drive unit is not limited thereto, and may be with some other mechanism such as an actuator.

Furthermore, though the direction of the apex of the conical shape of the rotor 42 and the thread groove spacer 43 is faced toward the lower side of FIG. 4 in this embodiment, it is not limited thereto, and the apex may be faced upward.

In addition, the vertical movement of the thread groove spacer 43 by the electrostrictive element 44 and the vertical movement of the rotor 42 by the control of the magnetic bearing unit 20 may be combined to vary the magnitude of the clearance 46 as described in the first embodiment.

Though the stator is formed with a thread groove in this embodiment, it is not limited thereto, and the thread groove may be formed on the rotor 42.

(Modification of the Second Embodiment)

In this modification, the magnitude of the clearance 46 is obtained by calculation from the temperature of a thread groove spacer 43.

The structure of the molecular pump in this modification employs a thermometer such as a thermistor instead of the eddy current sensor 47 in the molecular pump 41 in FIG. 4. Therefore, description will be made focusing on the molecular pump 41 below.

The thread groove spacer 43 is formed for example of aluminum or of stainless steel, and thus the coefficient of thermal expansion thereof is known in advance. The geometric dimensions of the thread groove spacer 43 at room temperature are known from the design values or the measured values. Therefore, if the temperature of the thread groove spacer 43 is known, the dimensions of the thread groove spacer 43 may be obtained by calculation.

Alternatively, if the relation between the temperature of the rotor 42 and the temperature of the thread groove spacer 43 under predetermined conditions are obtained by an experiment or the like, the temperature of the rotor 42 under such conditions may be estimated from the temperature of the groove spacer 43.

The rotor 42 is formed of aluminum or of stainless steel, and thus the coefficient of thermal expansion is known in advance. The dimensions of the rotor 42 at room temperature are known from the design values or the measured values. Therefore, if the temperature of the rotor 42 can be estimated, the geometrical dimensions of the rotor 42 can be estimated by calculation as in the case of the thread groove spacer 43.

The predetermined condition here includes the pressure of gas exhausted from the molecular pump 41 or the revolution of the rotor 11.

The relation between the temperatures of the rotor 42 and of the thread groove spacer 43 under such various conditions may be obtained for example from an experiment.

The relative positional relation between the thread groove spacer 43 and the rotor 42 at room temperature (for example, the positional relation in the direction of the axis of the rotor shaft 3) is known in advance from the design values, and this is a function of the axial length of the rotor shaft 3 of the electrostrictive element 44.

The magnitude of the clearance 46, being determined by the dimensions of the thread groove spacer 43 and the rotor 42, and the relative position thereof, is the function of the temperatures of the thread groove spacer 43 and the rotor 42, and the axial length of the rotor shaft 3 of the electrostrictive element 44.

Since the temperature of the rotor 42 can be estimated from the temperature of the thread groove spacer 43, as is clear from the consideration above, the magnitude of the clearance 46 may be estimated by calculation based on the temperature of the thread groove spacer 43 and the dimensions of the electrostrictive element 44.

The axial length of the rotor shaft 3 of the electrostrictive element 44 is a function of electric field impressed on the electrostrictive element 44 by the electrode mounted on the electrostrictive element 44, and a function of electric field impressed on the electrode mounted on the electrostrictive element 44. This can be obtained by calculation or by an experiment.

Figure 6:
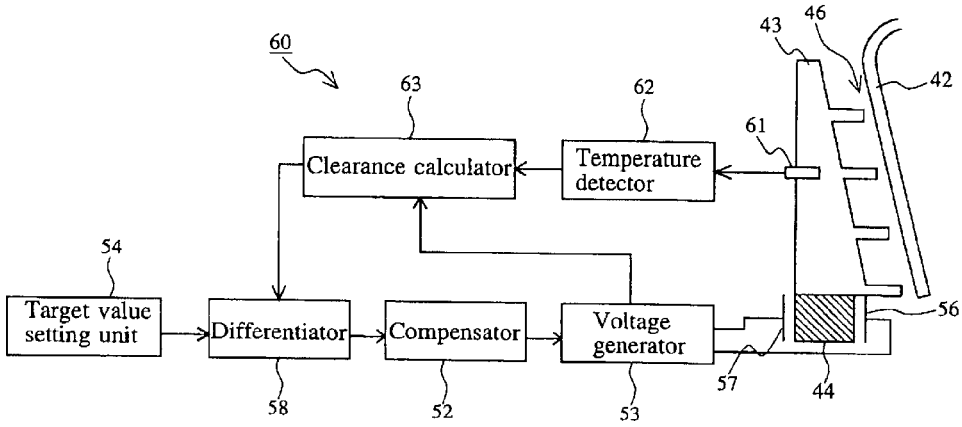
FIG. 6 is a view showing the structure of the electrostrictive element controller in a modification of the second embodiment.

FIG. 6 is a drawing showing the structure of an electrostrictive element controller 60 in this modification. The electrostrictive element controller 60 is constructed in such a manner that the eddy current sensor 47 is substituted with a thermistor 61, and the clearance magnitude detector 51 is substituted with a temperature detector 62 and a clearance calculator 63 in the electrostrictive element control system 55. The electrostrictive element controller 60 is provided in the control unit 25.

The thermistor 61 is formed of a metallic oxide whereof the value of resistance varies with temperature, and thus is an element whereof the temperature may be obtained from its value of resistance. The thermistor 61 is inserted into a hole formed on a thread groove spacer 43, so that the temperature of the thread groove spacer 43 may be measured.

It is also possible to use a thermocouple or some other thermometers instead of the thermistor 61.

The temperature detector 62 has a relative relation between the value of electric resistance and the temperature of the thermistor 61 in a form of a table or an equation, and outputs the temperature signals representing the temperature of the thread groove spacer 43 from the value of resistance of the thermistor 61.

The clearance calculator 63 acquires the temperature signals from the temperature detector 62, and acquires the voltage signals representing voltages applied on the electrostrictive element 44 from a voltage generator 53 to calculate the magnitude of the clearance 46.

In this manner, in this modification, a measuring device for measuring the clearance 46 is mainly constructed of the thermistor 61, the temperature detector 62, the clearance magnitude detector 63, and the voltage generator 53.

As is described above, the magnitude of the clearance 46 is a function of the temperature of the thread groove spacer 43 and the voltage applied on the electrostrictive element 44. The clearance calculator 63 includes a ROM (Read Only Memory) in which a function expression or a table for obtaining the magnitude of the clearance 46 with the temperature of the thread groove spacer 43 and the voltage to be applied on the electrostrictive element 44 as variables are recorded. The clearance calculator 63 obtains the magnitude of the clearance 46 by the use of the function or the table, and outputs the clearance magnitude signals representing the magnitude of the clearance to a detector 58.

The structures of an object value setting unit 54, the detector 58, a compensator 52, and a voltage generator 53 are the same as those in the control unit 25.

The voltage generator 53 outputs the signals representing the voltage supplied to the electrodes 56, 57 to the clearance calculator 63.

The molecular pump 41 according to this modification arranged as described above operates as follows.

When the molecular pump 41 of this embodiment is actuated, the rotor 11 rotates at a high speed, and gas is sucked through the inlet port 24 and discharged from an exhaust port 19 as in the second embodiment.

The electrostrictive element controller 60 estimate the magnitude of the clearance 46 from the temperature of the thread groove spacer 43 and the voltage applied on the electrostrictive element 44, and then performs feedback control on the voltage to be applied on the electrostrictive element 44 so that the magnitude of the clearance 46 agree with the target value preset by the target value setting unit 54.

When the user turns the dial and changes the target value in the target value setting unit 54, the electrostrictive element controller 60 adjusts the output voltage from the voltage generator 53 so that the value of the clearance 46 agrees with the value preset by the target value setting unit 54, while estimating the magnitude of the clearance 46 from the temperature of the thread groove spacer 43 and the voltage output from the voltage generator 53.

In the modification of the second embodiment described above, the temperature of the thread groove spacer 43 is detected by the less expensive thermistor or the like without using an expensive sensor, and the magnitude of the clearance 46 may indirectly be acquired.

In this modification, the temperature of the rotor 42 is estimated from the temperature of the thread groove spacer 43. However, it can also be constructed in such a manner that the temperature of the rotor 42 is detected by, for example, an infrared temperature sensor or the like without contact.

3. Third Embodiment

In the third embodiment, the clearance between the rotor and the thread groove spacer is adjusted by changing the inner diameter of the thread groove spacer that corresponds to the stator.

Figure 7:
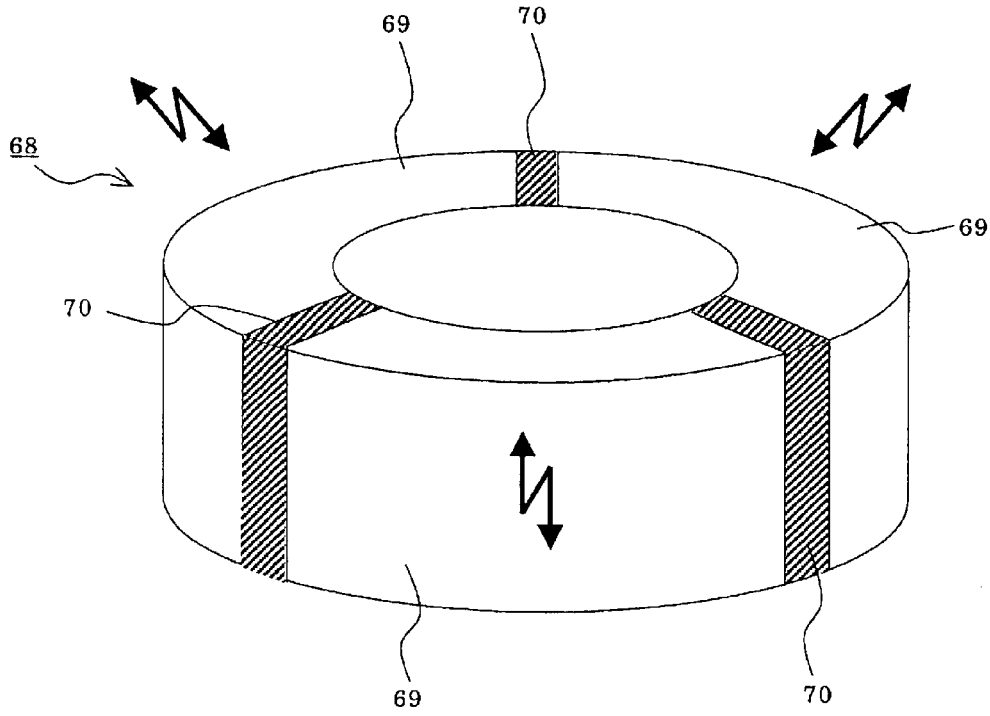
FIG. 7 is a view showing the structure of a thread groove spacer according to the third embodiment.
Figure 11:
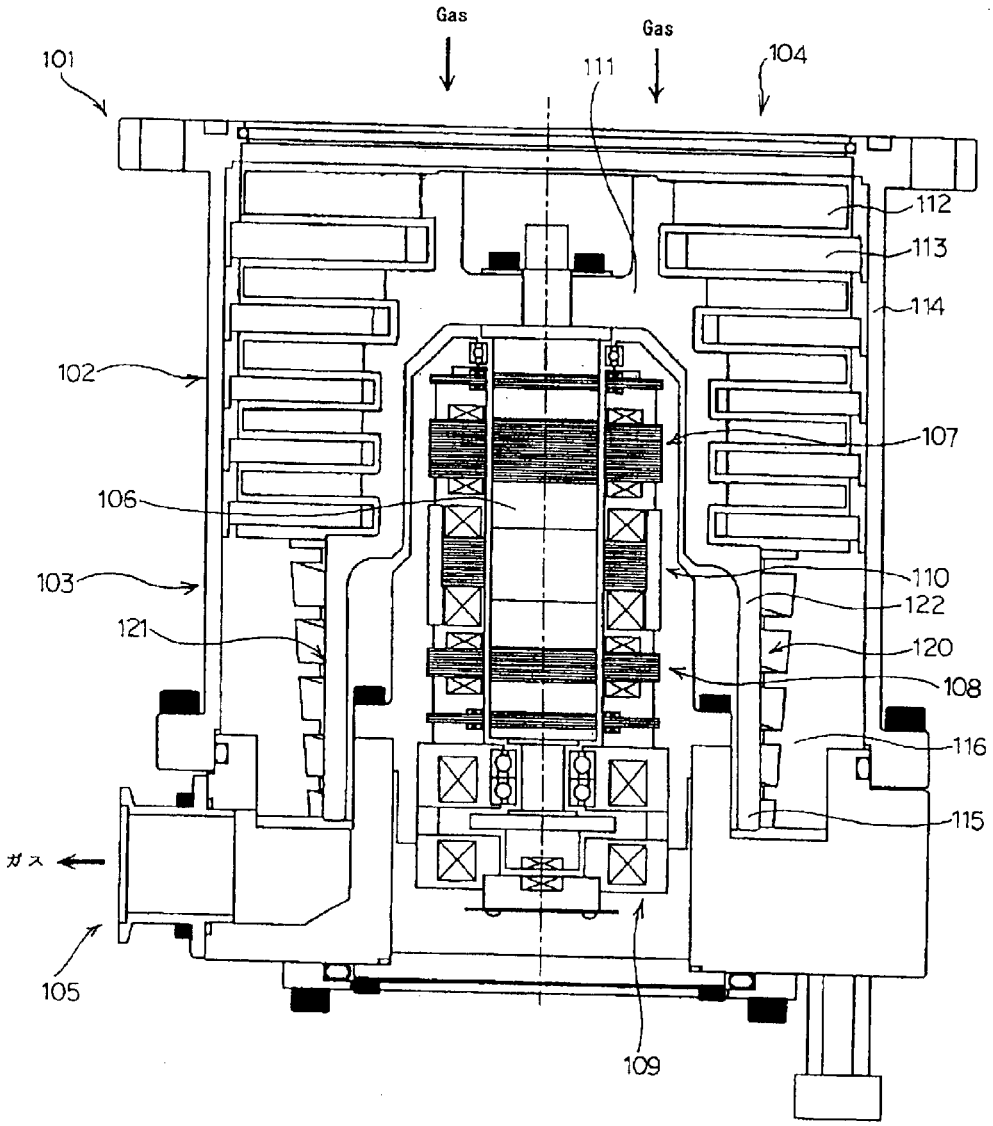
FIG. 11 is a drawing showing an example of the structure of the conventional molecular pump.
Figure 12:
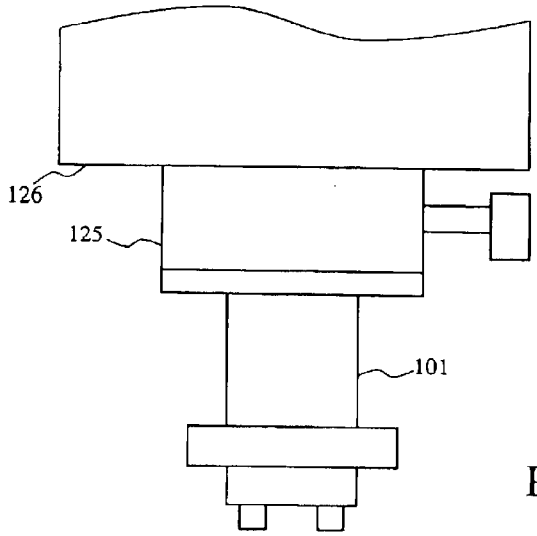
FIG. 12 is a drawing showing a connecting state in the related art in which the molecular pump and the vacuum device are connected by a gate valve.

The molecular pump in this embodiment is constructed in such a manner that a thread groove spacer 116 in a molecular pump 101 in the related art shown in FIG. 11 is substituted with the thread groove spacer 68 shown in FIG. 7, which is designated as a molecular pump 71. The structure of the molecular pump 71 is the same as the molecular pump 101 except for the thread groove pumping stage, and thus the same description will not be repeated.

FIG. 7 is a conceptual diagram showing the structure of the thread groove spacer 68. The thread groove formed on the inner peripheral surface of the thread groove spacer 68 is not shown. The rotor located on the inner peripheral section of the thread groove spacer 68 is not shown as well.

The thread groove spacer 68 is cylindrical shape formed with a thread groove on the inner peripheral surface thereof. The thread groove spacer 68 includes thread groove constituent members 69, 69, 69 that correspond to the stator constituent member formed of aluminum or stainless steel, and electrostrictive members 70, 70, 70 formed of electrostrictive element.

The thread groove constituent members 69, 69, 69 each has a shape constituting one of the parts of the cylindrical thread groove spacer 68 cut into substantially three equal sections in the circumferential direction.

The thread groove spacer 68 is formed by connecting these three thread groove constituent members 69, 69, 69 circumferentially of the thread groove spacer 68 with the electrostrictive members 70, 70, 70 interposed therebetween.

Though they are not shown in the figure, electrodes are attached to the electrostrictive members 70, 70, 70 and to the thread groove constituent members 69, 69, 69 at the boundaries between the electrostrictive members 70, 70, 70 and the thread groove constituent members 69, 69, 69, and the electrodes are insulated from the thread groove constituent members 69, 69, 69.

When a voltage is applied on the electrode, the electrostrictive members 70, 70, 70 expands or contracts in the circumferentially of the thread groove spacer 68, thereby varying the inner diameter of the thread groove spacer 68.

The inner diameter of the thread groove spacer 68 increases with expansion of the electrostrictive members 70, 70, 70, and decreases with contraction of the electrostrictive members 70, 70, 70.

In this manner, the clearance between the thread groove spacer 68 and the rotor that forms a surface opposing to the thread groove spacer 68 may be adjusted by varying the inner diameter of the thread groove spacer 68. Therefore, the electrostrictive members 70, 70, 70 make up an inner diameter varying device for varying the inner diameter of the thread groove spacer 68.

Figure 8:
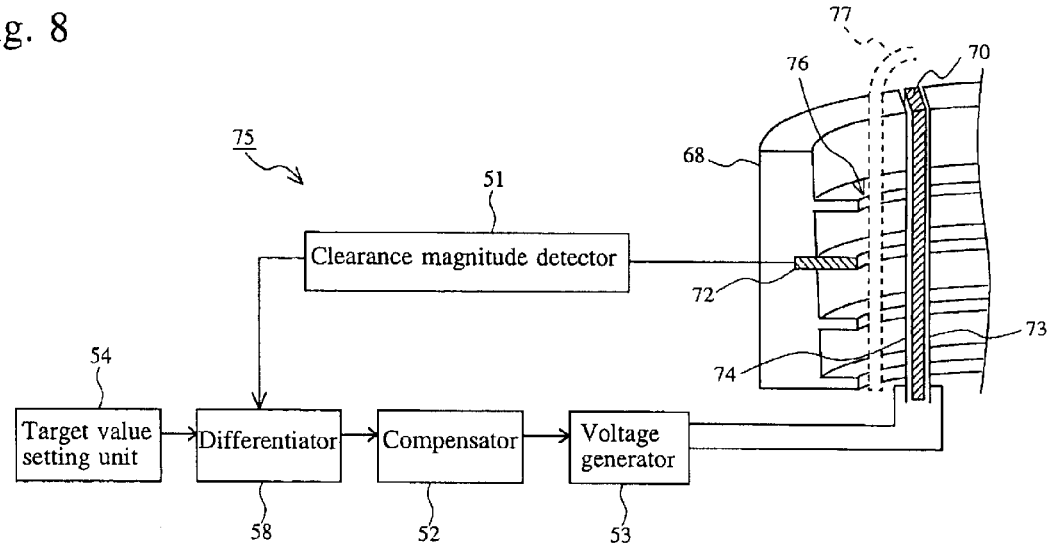
FIG. 8 is a view showing the structure of the electrostrictive element controller according to the third embodiment.

FIG. 8 is a drawing showing the structure of a electrostrictive member control system 75 for adjusting a clearance 76 between the thread groove spacer 68 and a rotor 77 by varying the thickness of the electrostrictive members 70, 70, 70.

FIG. 5 also shows a part of the structure of the molecular pump 71 (such as the thread groove spacer 68, the rotor 77, and so on). The thread groove spacer 68 and the rotor 77 are shown in cross section taken along the plane parallel to the plane of the figure, and the electrostrictive member 70, and the electrodes 73, 74 in this figure is a front view of those disposed on the near side of the plane of the figure.

The thread portion of the thread groove spacer 68 is provided with an eddy current sensor 72 so that the distal end is exposed toward the rotor 77. Since the eddy current sensor 72 is the same as the eddy current sensor 47 used in the second embodiment, the description will not be made again.

The eddy current sensor 72 moves in the radial direction with radial expansion and contraction of the thread groove spacer 68, and thus the magnitude of the clearance 76 may be detected based on the output from the eddy current sensor 72.

The clearance magnitude detector 51, the target value setting unit 54, the detector 58, the compensator 52, the voltage detector 53 are the same as those used in the electrostrictive element control system 55 in the second embodiment.

In other words, the detector 58 takes the difference between the target value acquired from the target value setting unit 54, and the output acquired from the clearance magnitude detector 51 and generates error signals, while the compensator 52 corrects the error signals and generates control signals. The voltage generator 53 outputs a predetermined voltage to the electrodes 73, 74 based on the control signals, and the electrostrictive members 70, 70, 70 are deformed into a predetermined thickness by electric field generated by the electrodes 73, 74. Consequently, the magnitude of the clearance 76 changes into the value preset by the target value setting unit 54.

The molecular pump 71 arranged as described above operates as follows.

When the molecular pump 71 is actuated, the rotor is rotated at a high speed by torque generated by the motor unit. Gas is sucked through the inlet port into the turbo molecular pumping stage, and then compressed in the thread groove pumping stage, and finally discharged from the exhaust port.

In the thread groove pumping stage, gas is transported through the thread groove formed on the thread groove spacer 68 by the rotor 77 that rotates in the thread groove at a high speed and compressed.

On the other hand, in the electrostrictive member control system 75, the clearance magnitude detector 51 monitors the clearance between the eddy current sensor 72 and the rotor 77 based on the output from the eddy current sensor 72.

The electrostrictive member control system 75 adjusts the voltage to be supplied to the electrodes 73, 74 and adjusts the thickness of the electrostrictive member 70 so that the target value preset by the target value setting unit 54 agrees with the clearance detected by the clearance magnitude detector 51.

Accordingly, the clearance 76 is set to a predetermined magnitude, and the compressibility of gas in the thread groove pumping stage is set to a suitable value.

The control unit for the molecular pump 71 is provided with a security device for varying the magnitude of the clearance 76 to a safe value immediately when a disturbance such as vibrations of the molecular pump 71 occurred due to an external force, and prevents interference between the rotor 77 and the thread groove spacer 68 as in the first embodiment.

In the third embodiment described thus far, the following effects may be achieved.

The exhaust capability of the molecular pump 71 may be controlled by controlling the clearance 77.

The magnitude of the clearance 76 may be adjusted by circumferential expansion and contraction of the electrostrictive members 70, 70, 70. Since the clearance 76 may be adjusted only by impressing electric field on the electrostrictive members 70, 70, 70, it needs little electricity to work. Furthermore, the electrostrictive element 76 is superior in responsibility.

In addition, such effects that the gate valve can be eliminated, and that the performance of the pump with high exhaust back pressure may be improved are the same as in the first embodiment.

Though the tread groove is formed on the thread groove spacer 68 in this embodiment, it is not limited thereto, and may be formed on the outer peripheral surface of the rotor.

(First Modification of the Third Embodiment)

In this modification, the inner diameter of the thread groove spacer is varied by expanding and contracting the electrostrictive elements disposed on the outer peripheral surface of the trisected thread groove spacer, whereby the magnitude of the clearance between a thread groove spacer 82 and the rotor is adjusted. The portions other than the thread groove pumping stage, such as the turbo molecular pumping stage or the magnetic bearing unit are the same as the molecular pump 71 in the third embodiment.

Figure 9:
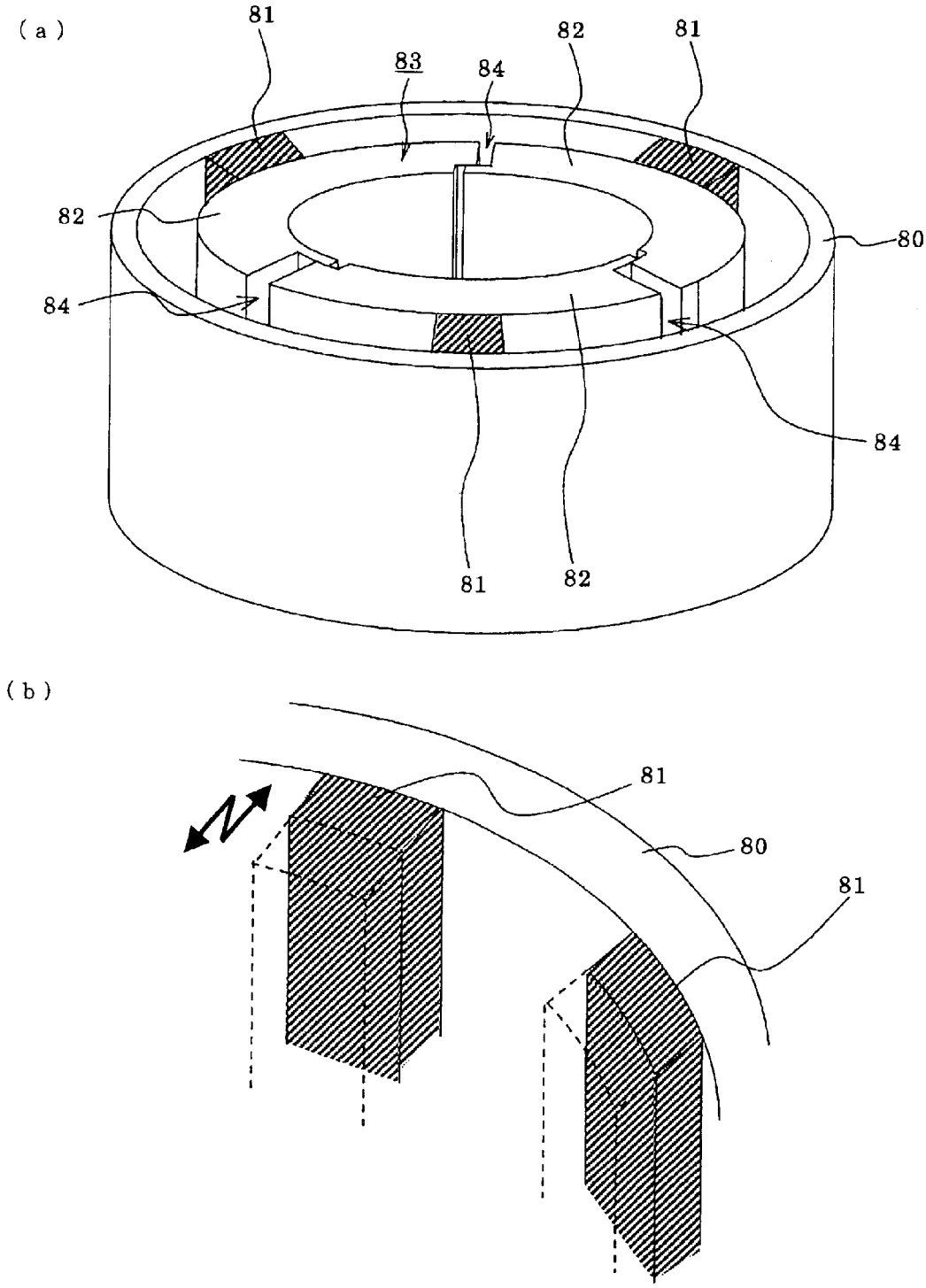
FIG. 9A is an explanatory drawing illustrating the structure of the thread groove spacer constituting the thread groove pumping stage according to a first modification of the third embodiment.
FIG. 9B is a drawing showing expansion and contraction of the electrostrictive element when a electric voltage is applied on the electrostrictive element.

FIG. 9A is an explanatory drawing illustrating the structure of a thread groove spacer 83 constituting the thread groove pumping stage in this modification. The rotor rotating along the inner periphery of the thread groove spacer 83 is not shown.

The portions other than the thread groove spacer such as the turbo molecular pumping stage and the magnetic bearing unit are the same as the third embodiment.

The thread groove spacer 83 is trisected into the spacer members 82, 82, 82, and a thread groove as a gas passage for transporting gas is formed on the inner peripheral surface of the thread groove spacer 83, though it is not shown in the figure.

The spacer members 82, 82, 82 may be moved radially of the thread groove spacer 83. When the spacer members 82, 82, 82 are moved toward the center of the radius, the inner diameter of the thread groove spacer 83 decreases, while when the spacer members 82, 82, 82 are moved away from the center of the radius, the inner diameter of the thread groove spacer 83 increases.

Circumferential side surfaces of each spacer members 82, 82, 82 are such that one side is projected and the other side is recessed, so that the projection on one spacer member 82 fits into the recess on the other spacer member 82 at each connecting section between the adjacent spacer members 82, 82, 82. A clearance 84 is provided between the adjacent spacer members 82, 82, 82.

Though it is not shown in the figure, the projections and recesses on the side surfaces of the spacer members 82, 82, 82 are formed along the thread groove formed on the inner surfaces of the spacer members 82, 82, 82.

When the spacer members 82, 82, 82 are moved toward the center axis of the thread groove spacer 83, the fitted portion on the side surfaces of the spacer members 82, 82, 82 slide in the circumferential direction. The fitted portion serves to prevent gas transported along the thread groove from leaking from between the adjacent spacer members 82, 82, 82.

Electrostrictive elements 81, 81, 81 are attached on the outer peripheral surface of the spacer members 82, 82, 82 respectively. The electrostrictive elements 81, 81, 81 are provided with electrodes, not shown, on the side surfaces (surfaces perpendicular to the circumferential direction of the thread groove spacer 83) of the electrostrictive elements 81, 81, 81, so that a voltage can be applied on the electrostrictive elements 81, 81, 81. The electrostrictive elements 81, 81, 81 expand and contract radially of the thread groove spacer 83 when being applied with a voltage as shown in FIG. 9B The surfaces of the electrostrictive elements opposite from the surfaces attached to the spacer members 82, 82, 82 are attached on the inner peripheral surface of a casing 80.

The spacer 82, 82, 82 may be moved radially of the thread groove spacer 83 by the electrostrictive elements 81, 81, 81. Accordingly, the inner diameter of the thread groove spacer 83 varies, and thus the clearance between the thread groove spacer 83 and the rotor, not shown, may be adjusted.

The thread groove spacer 83 is provided with an eddy current sensor. The distal end of the eddy current sensor is exposed from the thread, and is able to be used when measuring the clearance between the thread groove spacer 83 and the rotor, not shown.

The eddy current sensor and the electrodes mounted on the electrostrictive elements 81, 81, 81 are connected to the electrostrictive element controller which is equivalent to the electrostrictive element controller 55 of the second embodiment, and this electrostrictive element controller performs feedback control on the clearance based on the target value set by the user.

The operation of the molecular pump in this modification will be described below. The components other than the thread groove pumping stage are the same as those in the molecular pump 71 of the third embodiment, and thus the description will be focused on the operation of the thread groove pumping stage. Since the electrostrictive element controller which is equivalent to the electrostrictive control system 55 described in conjunction with the second embodiment may be used as the one for controlling a voltage to be applied on the electrostrictive elements 81, 81, 81, it is incorporated herein, and thus the respective components will be represented by the same reference numerals and signs in the description.

There are three pairs of electrodes 56, 57 in the electrostrictive element control system 55, which are mounted on the side surfaces of the electrostrictive elements 81, 81, 81 respectively. The electrostrictive element control system 55 controls a voltage to be applied on each electrode so that the amounts of expansion and contraction of the respective electrostrictive elements 81, 81, 81 become equivalent.

When the molecular pump of this modification is actuated, the rotor is magnetically levitated and rotated at a high speed. Then gas is sucked through the inlet port, compressed in the turbo molecular pumping stage and then in the thread groove pumping stage, and finally discharged from the exhaust port.

On the other hand, in the electrostrictive element control system 55, the clearance magnitude detector 51 monitors the clearance between the eddy current sensor 72 and the rotor 77 based on the output of the eddy current sensor 72.

The electrostrictive element control system 55 adjusts the voltage to be applied on the electrodes 73, 74 and adjusts the thickness of the electrostrictive element 81 so that the target value preset by the target value setting unit 54 agrees with the clearance detected by the clearance magnitude detector 51.

Consequently, the clearance between the thread groove spacer 83 and the rotor is set to a predetermined magnitude, and thus the gas compressibility in the thread groove pumping stage is set to a suitable value.

When it is adapted in such a manner that the user can vary the target value in the target value setting unit 54, the user can vary the compressibility in the thread groove pumping stage by varying the target value, and thus the exhaust capability of the molecular pump may be adjusted.

The control unit for the molecular pump 71 is provided with a security device for varying the magnitude of the clearance 76 to a safe value immediately when a disturbance such as vibrations of the molecular pump 71 occurred due to an external force, and prevents interference between the rotor 77 and the thread groove spacer 68 as in the case of the first embodiment.

(Second Modification of Third Embodiment)

In this modification, the clearance between the thread groove spacer and the rotor forming the surface opposing thereto is adjusted by forming the thread of the thread groove spacer of the electrostrictive element, and expanding and contracting the thread.

Figure 10:
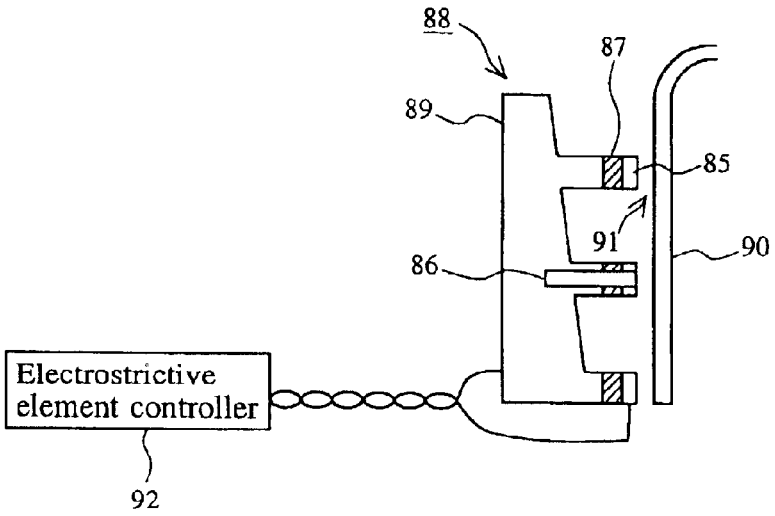
FIG. 10 is a conceptual diagram for illustrating the structure of the thread groove spacer according to an embodiment 2 of the third embodiment.

FIG. 10 is a conceptual diagram for illustrating the structure of a thread groove spacer 88 according to this modification. FIG. 10 shows a part of the cross section of the thread groove spacer 88, a part of the cross section of a rotor 90 facing toward the inner peripheral surface of the thread groove spacer 88, and an electrostrictive element controller 92 for controlling the electrostrictive element.

The thread groove spacer 88 constitutes a thread groove pumping stage of a molecular pump provided with a turbo molecular pumping stage on the upper side, and a thread groove pumping stage on the lower side. The structure of the molecular pump other than the thread groove pumping stage is the same as the molecular pump 101 of the related art shown in FIG. 11, and thus the description will not be made again.

The thread groove spacer 88 is formed in a cylindrical shape, and a thread groove is formed on the inner peripheral surface thereof for guiding gas. The depth of the thread groove is reduced gradually toward the downstream of the gas flow (lower side of the figure), so that guided gas is compressed.

A peripheral member 89 forming an outer peripheral surface of the thread groove spacer 88 is formed of metal such as aluminum or stainless steel. The portion forming a certain thickness from the inner peripheral surface of the thread is formed of an electrostrictive member 87, and an electrode 85 is attached on the distal end of the thread.

The peripheral member 89 and the electrode 85 are connected to the electrostrictive element controller 92 respectively. Since the peripheral member 89 is formed of metal, it may acts as an electrode. Therefore, when a voltage is applied between the peripheral member 89 and the electrode 85, electric field is impressed on the electrostrictive member 87, and thus the electrostrictive member 87 expands and contracts. The electrostrictive member 87 is adapted to expand and contract radially of the thread groove spacer 88.

The electrode 85 is formed of integral metal over the entire thread, and the thickness of the electrostrictive member 87 is constant over the entire thread. Therefore, the magnitude of the electric field impressed on the electrostrictive member 87 is constant over the entire thread, and thus the amount of expansion and contraction is constant over the entire thread.

An eddy current sensor 86 is an element for measuring the magnitude of a clearance 91, and is provided on the thread of the thread groove spacer 88. The structure and the function of the eddy current sensor 86 are the same as the eddy current sensor 47 in the second embodiment. The eddy current sensor 86 is adapted to be moved with the distal end of the thread when the electrostrictive member 87 expands and contracts and thus the clearance 91 varies. Therefore, the distance from the distal end of the thread to the rotor 90, or the clearance 91 may be acquired from the output of the eddy current sensor 86.

The electrostrictive element controller 92 acquires the magnitude of the clearance 91 based on the output from the eddy current sensor 86, and performs feedback control on the voltage to be applied on the peripheral member 89 and the electrode 85 so that the magnitude of the clearance 91 agrees with a predetermined target value. The structure of the electrostrictive element controller 92 is the same as the electrostrictive member control system 75 in the third embodiment, and thus the description will not be made again.

The molecular pump provided with the thread groove spacer 88 arranged as described above operates as follows.

When the molecular pump is actuated, gas is sucked through the inlet port, and the sucked gas is compressed in the turbo molecular pumping stage and then in the thread groove pumping stage, and finally discharged form the exhaust port.

The electrostrictive element controller 92 compares the target value of the magnitude of the predetermined clearance 91 with the magnitude of the clearance 91 acquired from the output of the eddy current sensor 86, and then adjusts the voltage to be applied on the peripheral member 89 so that the magnitude of the clearance 91 agrees with the target value, and the electrode 85 and adjusts the amount of the expansion and contraction of the electrostrictive member 87.

The amount of gas leaked through the clearance 91 between the thread groove spacer 88 and the rotor 90 is adjusted by the magnitude of the clearance 91. When the magnitude of the clearance 91 is significant, the gas compressibility in the thread groove pumping stage is lowered because the quantity of gas leaked through the clearance 91, and when the magnitude of the clearance 91 is small, the amount of gas leaked through the clearance 91, and thus the gas compressibility in the thread groove pumping stage is improved because the quantity of gas leaked through the clearance 91.

Therefore, the exhaust capability of the molecular pump may be adjusted by varying the target value to be set by the electrostrictive element controller 92

In this modification described thus far, the following effects may be achieved.

Since the thread of the thread groove spacer expands and contracts, a mechanism to move the thread groove spacer in the thrust direction or in the radial direction as in the case of the second and third embodiments is not necessary.

Furthermore, the effects achieved owing to the fact that the clearance 91 is controllable, or such effects that the exhaust capability of the molecular pump may be adjusted, that the gate valve can be eliminated, and that the exhaust capability of the molecular pump may be improved in comparison with the related art by reducing the magnitude of the clearance 91 are the same as the first to third embodiments.

Though the molecular pump including the turbo molecular pumping stage and the thread groove pumping stage has been described as an example in conjunction with the first to the third embodiment, the configuration of the molecular pump is not limited thereto, and may be applied widely to a molecular pump having only a thread groove pump, or a molecular pump including a thread groove pump as a component.

The respective embodiments described thus far have a function to control the clearance between the opposing surfaces of the rotor and the stator (stationary portion), and thus the pressure in the exhausted container can be controlled. Therefore, it is possible to dispose a pressure gauge in the exhausted container, and to perform feedback control on the magnitude of the clearance between the opposing surfaces of the rotor and the stator based on the output of the pressure gauge. In other words, the target pressure, which is a target in the exhausted container, is set in advance, and when the pressure in the exhausted container is lower than the target pressure, the clearance is increased to lower the exhaust capability of the molecular pump, and when the pressure in the exhausted container exceeds the target pressure, the clearance is reduced to increase the exhaust capability of the molecular pump, so that the pressure in the exhausted container may be maintained at a target pressure.

What is claimed is:

1. A molecular pump comprising:

a casing having an interior space, an inlet port for connection to a chamber to be exhausted during operation of the molecular pump by the introduction of gas molecules from the chamber into the interior space, and an outlet port for discharging the gas molecules from the interior space;

a stator mounted in the interior space of the casing;

a rotor mounted in the interior space of the casing for undergoing rotation relative to the stator during exhaustion of the chamber, the rotor having a surface disposed opposite to and confronting a surface of the stator;

a motor for rotationally driving the rotor relative to the stator;

a thread groove formed in at least one of the opposite and confronting surfaces of the stator and the rotor;

a transport device for transporting gas molecules introduced into the interior space of the casing through the thread groove during rotation of the motor;

a clearance varying device for varying a magnitude of a clearance between the opposite and confronting surfaces of the stator and the rotor; and an exhaust controlling device for controlling a degree of exhaustion of the chamber by adjusting the magnitude of the clearance between the opposite and confronting surfaces of the stator and the rotor to a preselected target value during operation of the molecular pump.

2. A molecular pump according to claim 1; wherein the surface of the rotor disposed opposite to and confronting the surface of the stator has a bus line disposed at an angle greater than zero degrees relative to a rotational axis of the rotor; and wherein the clearance varying device varies the magnitude of the clearance by moving at least one of the rotor and the stator in the direction of the rotational axis of the rotor.

3. A molecular pump according to claim 2; further comprising a magnetic bearing device for magnetically levitating the rotor; and wherein the clearance varying device varies the magnitude of the clearance between the opposite and confronting surfaces of the stator and the rotor by varying a levitated position of the rotor.

4. A molecular pump according to claim 2; further comprising an elastic member for supporting the stator and configured to undergo expansion and contraction movement in the direction of the rotational axis of the rotor; and wherein the clearance varying device varies the magnitude of the clearance between the opposite and confronting surfaces of the stator and the rotor by moving the stator in the direction of the rotational axis of the rotor through expansion and contracting movement of the elastic member.

5. A molecular pump according to claim 4; wherein the elastic member comprises an electrostrictive element configured to undergo expansion and contraction movement by application of an electrical voltage thereto; and wherein the clearance varying device varies the magnitude of the clearance between the opposite and confronting surfaces of the stator and the rotor by varying the electrical voltage applied to the electrostrictive element to undergo expansion and contraction movement.

6. A molecular pump according to claim 1; wherein the rotor and the stator have a generally cylindrical-shaped outer peripheral surface and a generally cylindrical-shaped inner peripheral surface, respectively; and wherein the clearance varying device includes an inner diameter varying device for varying an inner diameter of the inner peripheral surface of the stator.

7. A molecular pump according to claim 6; wherein the stator comprises a plurality of stator members and an elastic member connecting the stator members together and configured to undergo expansion and contraction movement in a circumferential direction of the stator; and wherein the inner diameter varying device varies the inner diameter of the inner peripheral surface of the stator through expansion and contracting movement of the elastic member.

8. A molecular pump according to a claim 6; wherein the stator comprises a plurality of stator members spaced apart from one another to define a clearance therebetween and an elastic member having a first end connected to an outer peripheral surface of each of the stator members and a second end integrally connected to a base portion of the molecular pump, the elastic member being configured to undergo expansion and contraction movement in a radial direction of the inner peripheral surface of the stator; and wherein the inner diameter varying device varies the inner diameter of the inner peripheral surface of the stator through expansion and contraction movement of the elastic member.

9. A molecular pump according to claim 6; wherein the inner peripheral surface of the stator comprises the surface thereof confronting the surface of the rotor, the thread groove being formed in the inner peripheral surface of the stator; wherein at least a portion of the thread groove is formed of an elastic member configured to undergo expansion and contraction movement in a radial direction of the inner peripheral surface of the stator; and wherein the inner diameter varying device varies the inner diameter of the inner peripheral surface of the stator through expansion and contracting movement of the elastic member.

10. A molecular pump according to claim 1; further comprising a measuring device for measuring the magnitude of the clearance between the opposite and confronting surfaces of the rotor and the stator; and wherein the exhaust controlling device adjusts the magnitude of the clearance between the opposite and confronting surfaces of the rotor and the stator to the preselected target value in accordance with the magnitude of the clearance measured by the measuring device.

11. A molecular pump according to claim 1; further comprising a detection device for detecting an abnormal circumstance in which the rotor and the stator may come into contact with each other; and an emergency control device for varying the clearance between the rotor and the stator at least to the extent to avoid contact between the rotor and the stator when the abnormal condition is detected by the detection device.

12. A molecular pump according to claim 1; wherein the clearance varying device includes a pressure control device for varying the magnitude of the clearance in accordance with the pressure of the gas in the chamber to thereby control the pressure in the chamber.

13. A molecular pump comprising:

a casing having an interior space, an inlet port for connection to a chamber to be exhausted during operation of the molecular pump by the introduction of gas molecules from the chamber into the interior space, and an outlet port for discharging the gas from the interior space;

a first pumping stage disposed in the interior space of the casing for compressing gas introduced into the interior space from the chamber during operation of the molecular pump, the first pumping stage having a stator and a rotor mounted to undergo rotation relative to the stator;

a second pumping stage disposed in the interior space of the casing for further compressing the gas compressed in the first pumping stage during operation of the molecular pump, the second pumping stage including a portion of the rotor and a portion of the stator so that a surface of the portion of the rotor is disposed in confronting and spaced-apart relation to a surface of the portion of the stator, and a groove formed in at least one of the confronting and spaced-apart surfaces of the portions of the rotor and the stator; and control means for controlling a magnitude of a clearance between the confronting and spaced-apart surfaces of the portions of the rotor and the stator during operation of the molecular pump to thereby control a degree of exhaustion of the chamber.

14. A molecular pump according to claim 13; wherein the control means comprises a clearance varying device for varying the magnitude of the clearance between the confronting and spaced-apart surfaces of the portions of the rotor and the stator; and an exhaust controlling device for controlling the degree of exhaustion of the container by adjusting the magnitude of the clearance between the confronting and spaced-apart surfaces of the portions of the rotor and the stator to a preselected target value during operation of the molecular pump.

15. A molecular pump according to claim 13; wherein the clearance between the confronting and spaced-apart surfaces of the portions of the rotor and the stator defines a passage that allows gas to pass through the groove of the second pumping stage during operation of the molecular pump.

16. A molecular pump according to claim 13; wherein the groove of the second pumping stage is generally helical-shaped.

17. A molecular pump according to claim 13; wherein the groove of the second pumping stage is formed in the surface of the portion of the stator disposed in confronting and spaced-apart relation to the surface of the portion of the rotor.

18. A molecular pump according to claim 17; wherein the portion of the rotor comprises a generally circular-shaped disc having the surface disposed in confronting and spaced-apart relation to the surface of the portion of the stator.

19. A molecular pump according to claim 13; further comprising an elastic member supporting the stator and configured to undergo expansion and contraction movement in a direction of a rotational axis of the rotor; and wherein the control means includes means for varying the magnitude of the clearance between the opposite and confronting surfaces of the portions of the stator and the rotor by moving the stator in the direction of the rotational axis of the rotor through expansion and contraction movement of the elastic member.

20. A molecular pump according to claim 13; wherein the control means includes means for varying the magnitude of the clearance between the opposite and confronting surfaces of the portions of the stator and the rotor by varying a diameter of the surface of the portion of the stator.

* * * * *